US011511397B2

(12) United States Patent
Wu

(10) Patent No.: US 11,511,397 B2
(45) Date of Patent: Nov. 29, 2022

(54) ADJUSTABLE OPEN END WRENCH

(71) Applicant: Ming Chieh Wu, Taichung (TW)

(72) Inventor: Ming Chieh Wu, Taichung (TW)

( * ) Notice: Subject to any disclaimer, the term of this patent is extended or adjusted under 35 U.S.C. 154(b) by 255 days.

(21) Appl. No.: 17/021,285

(22) Filed: Sep. 15, 2020

(65) Prior Publication Data

US 2022/0048164 A1 Feb. 17, 2022

(30) Foreign Application Priority Data

Aug. 17, 2020 (TW) ..... 109127976

(51) Int. Cl.
*B25B 13/24* (2006.01)

(52) U.S. Cl.
CPC ..... *B25B 13/24* (2013.01)

(58) Field of Classification Search
CPC ..... B25B 13/12; B25B 13/46; B25B 13/22; B25B 13/20; B25B 13/24; B25B 13/5058
See application file for complete search history.

(56) References Cited

FOREIGN PATENT DOCUMENTS

TW I613044 B 2/2018

*Primary Examiner* — Orlando E Aviles
*Assistant Examiner* — Thomas Raymond Rodgers
(74) *Attorney, Agent, or Firm* — Alan D. Kamrath; Karin L. Williams; Mayer & Williams PC

(57) ABSTRACT

An adjustable open end wrench includes a pivot extending through a handle and a first jaw, permitting the first jaw to pivot relative to the handle. A second jaw is pivotably connected to the handle and is slidably connected to the first jaw. An elastic element is disposed between the handle and the second jaw. The second jaw includes a second driving portion facing a first driving portion of the first jaw. The first and second jaws are jointly pivotable relative to the handle between first and second positions. The first and second driving portions are close to each other when the first and second jaws are in the first position. The first and second driving portions are away from each other when the first and second jaws are in the second position. The elastic element is configured to move the second jaw towards the first position.

7 Claims, 10 Drawing Sheets

ADJUSTABLE OPEN END WRENCH

BACKGROUND OF THE INVENTION

The present invention relates to a wrench and, more particularly, to an adjustable open end wrench.

Taiwan Patent No. 1613044 discloses an adjustable open end wrench including a first jaw, a second jaw, and a jaw jacket. The first jaw includes a first abutting face. The second jaw is movable relative to the first jaw and includes a second abutting face. The second abutting face is parallel to the first abutting face of the first jaw. The first and second abutting faces together define a jaw opening for receiving a nut. The jaw jacket includes a toothed face and is mounted around the second jaw. The toothed face and the first abutting face of the first jaw together define a clamping opening for clamping a pipe.

However, in a case that the above adjustable open end wrench is used to wrench a bolt, after rotating through a predetermined angle, the adjustable open end wrench must be rotated back to the original position before next wrenching operation, leading to a poor operational efficiency.

Thus, a need exists for a novel adjustable open end wrench that mitigates and/or obviates the above drawback.

BRIEF SUMMARY OF THE INVENTION

An objective of the present invention is to provide an adjustable open end wrench including a handle, a first jaw, and a second jaw. The handle includes an end having a first pivotal portion and a second pivotal portion. The first pivotal portion includes a pivotal hole. The first jaw includes a pivotal groove. A pivot is disposed to the first jaw and extends through the pivotal hole and the pivotal groove, permitting the first jaw to pivot relative to the handle. The first jaw includes a first driving portion. The second jaw is pivotably connected to the second pivotal portion. The second jaw is slidably connected to the first jaw. An end of the second jaw opposite to the first jaw is connected to an elastic element. An end of the elastic element is connected to the second jaw. Another end of the elastic element is connected to the handle. The second jaw includes a second driving portion. The first and second driving portions face each other. The first and second jaws are jointly pivotable relative to the handle between a first position and a second position. The first and second driving portions are close to each other when the first and second jaws are in the first position. The first and second driving portions are away from each other when the first and second jaws are in the second position. The elastic element is configured to move the second jaw towards the first position.

In an example, the second pivotal portion includes a first peripheral portion having a first pivotal groove. A first pivotal ear protrudes from the second jaw and is received in the first pivotal groove. The second jaw is pivotable relative to the handle about a pivotal axis defined by the first pivotal ear.

In an example, the second pivotal portion includes a second peripheral portion having a first limiting groove. The second peripheral portion is located between the first peripheral portion and another end of the handle. A first limiting block protrudes from the second jaw and is located on a side of the first pivotal ear opposite to the second driving portion. The first limiting block abuts against an inner wall of the first limiting groove when the second jaw is in the first position. The first limiting block disengages from the first limiting groove when the second jaw is in the second position.

In an example, the pivotal groove includes a first coupling portion on an inner wall thereof. The pivot includes a second coupling portion on an outer periphery thereof. The pivot is movable along a longitudinal axis thereof to couple the second coupling portion with the first coupling portion or to disengage the second coupling portion from the first coupling portion. The pivot is prevented from moving in the pivotal groove in a radial direction perpendicular to the longitudinal axis when the second coupling portion engages with the first coupling portion. The pivot is movable in the pivotal groove in the radial direction perpendicular to the longitudinal axis when the second coupling portion disengages from the first coupling portion.

In an example, a stop plate includes a first end mounted to the handle and a second end abutting an end of the pivot. The stop plate is resilient and is configured to bias the pivot to couple the second coupling portion with the first coupling portion.

In an example, the handle includes a first lug and a second lug. The pivotal hole extends through the first lug and the second lug. The first jaw is disposed between the first lug and the second lug. The first pivotal groove and the first limiting groove are located on an outer periphery of the first lug. The second lug includes an outer periphery having a second pivotal groove and a second limiting groove. The second jaw includes a second pivotal ear and a second limiting block. The second pivotal ear is received in the second pivotal groove to permit the second jaw to pivot relative to the handle about the pivotal axis defined by the first and second pivotal ears. The second limiting block is located on a side of the second pivotal ear opposite to the second driving portion. The second limiting block abuts against an inner wall of the second limiting groove when the second jaw is in the first position. The second limiting block disengages from the second limiting groove when the second jaw is in the second position.

In an example, the first jaw includes a first sliding groove and a second sliding groove which are disposed on two opposite sides of the first jaw. The second jaw includes a receiving groove. The first jaw is slidably received in the receiving groove. The first pivotal ear and the second pivotal ear are located on two sides of the receiving groove, respectively. The first limiting block and the second limiting block are located on two sides of the receiving groove, respectively. The receiving groove includes a first sliding ledge and a second sliding ledge on two opposite walls thereof. The first sliding ledge is received in the first sliding groove. The second sliding ledge is received in the second sliding groove.

In an example, the first and second sliding ledges are located between the first lug and the second lug.

In an example, the elastic element is a tension spring.

The present invention will become clearer in light of the following detailed description of illustrative embodiments of this invention described in connection with the drawings.

DETAILED DESCRIPTION OF THE INVENTION

Figure 1:
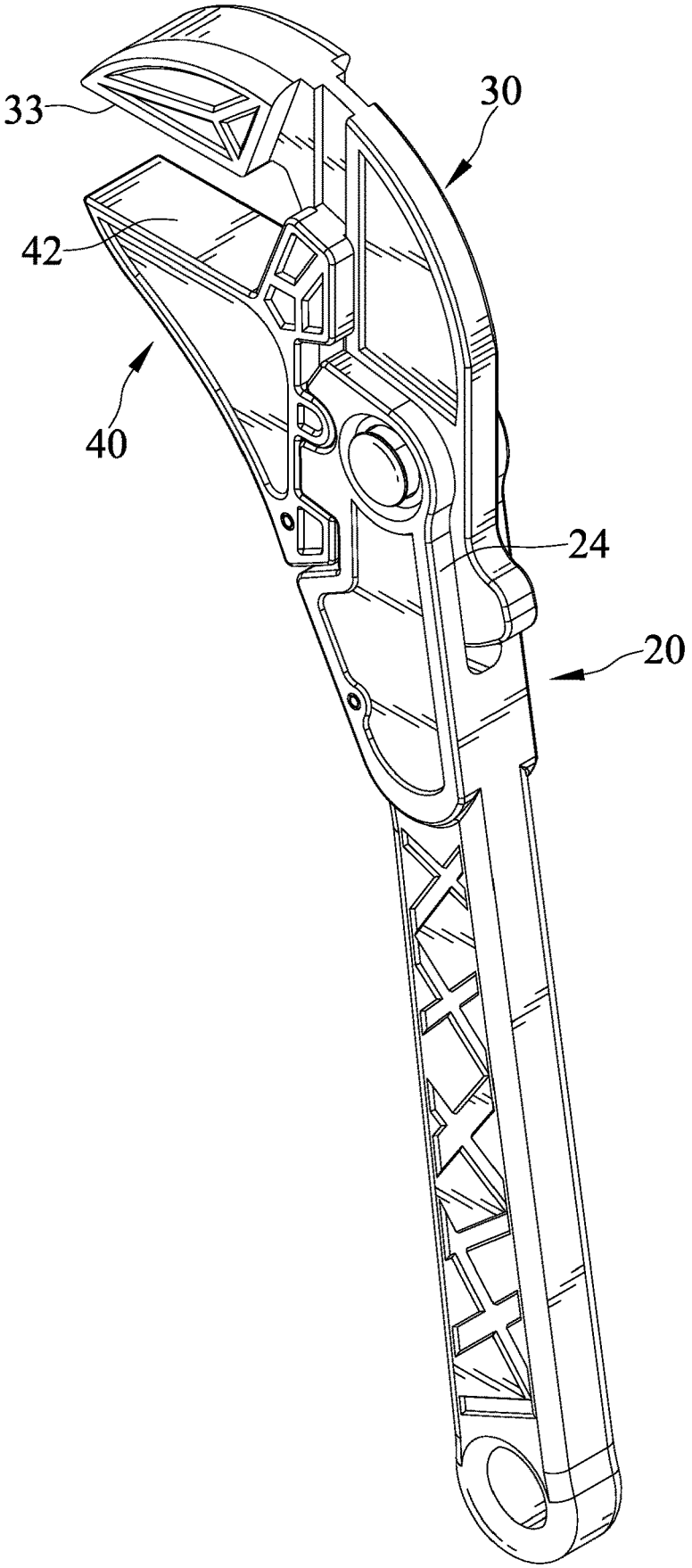
FIG. 1 is a perspective view of an adjustable open end wrench of an embodiment according to the present invention.
Figure 2:
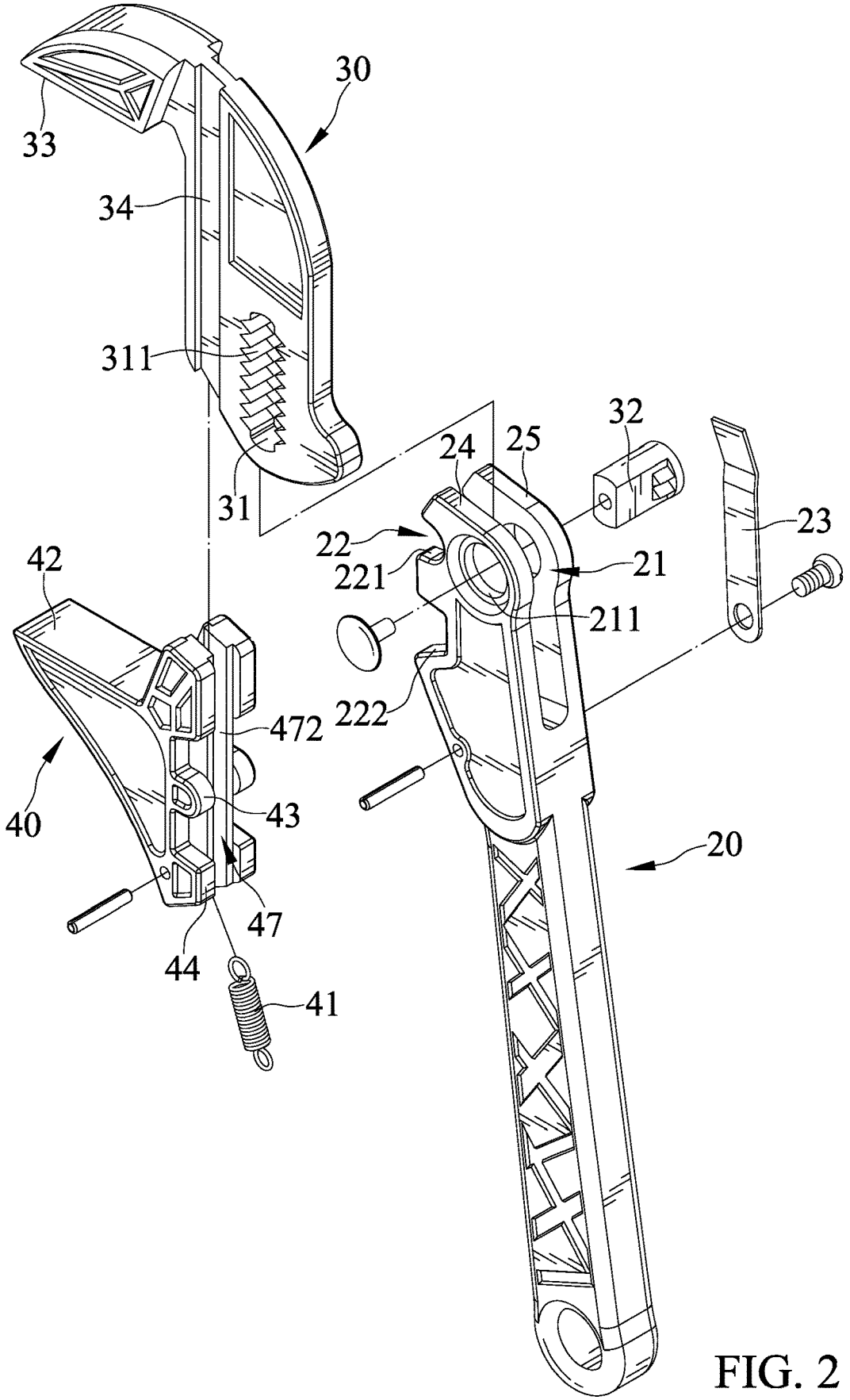
FIG. 2 is an exploded, perspective view of the adjustable open end wrench of FIG. 1.
Figure 3:
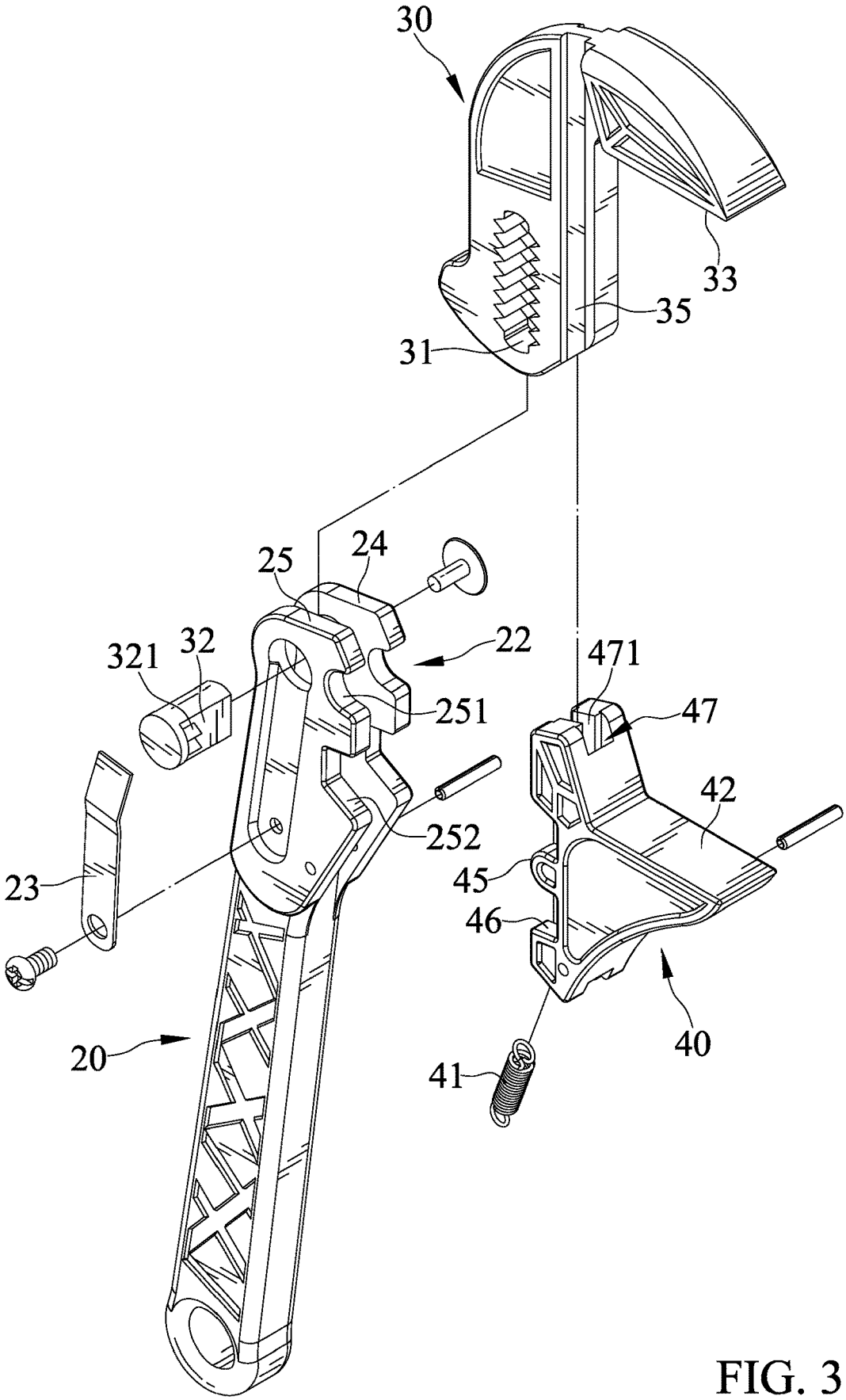
FIG. 3 is another exploded, perspective view of the adjustable open end wrench of FIG. 1.
Figure 4:
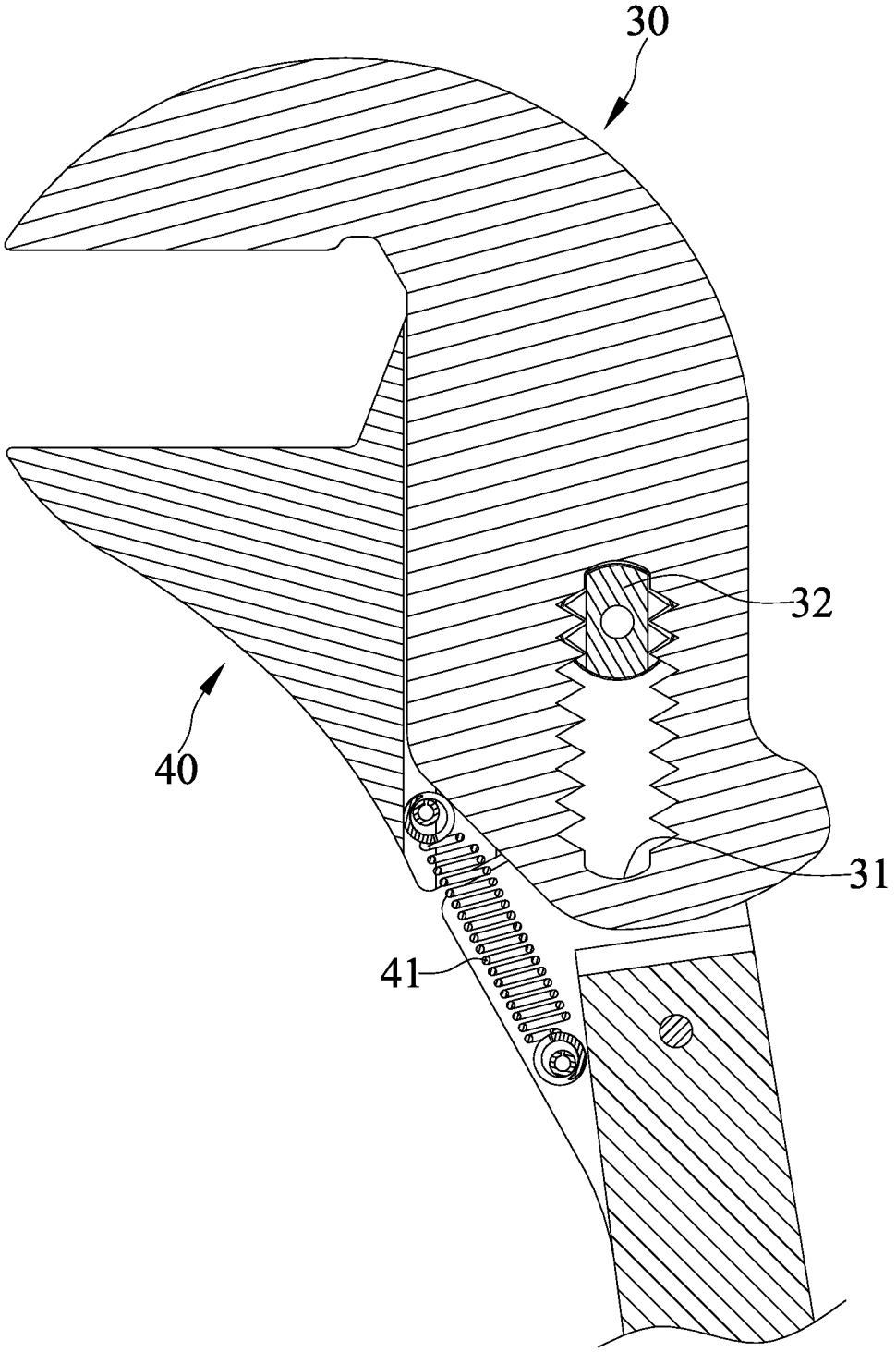
FIG. 4 is a partial, cross sectional view of the adjustable open end wrench of FIG. 1.
Figure 5:
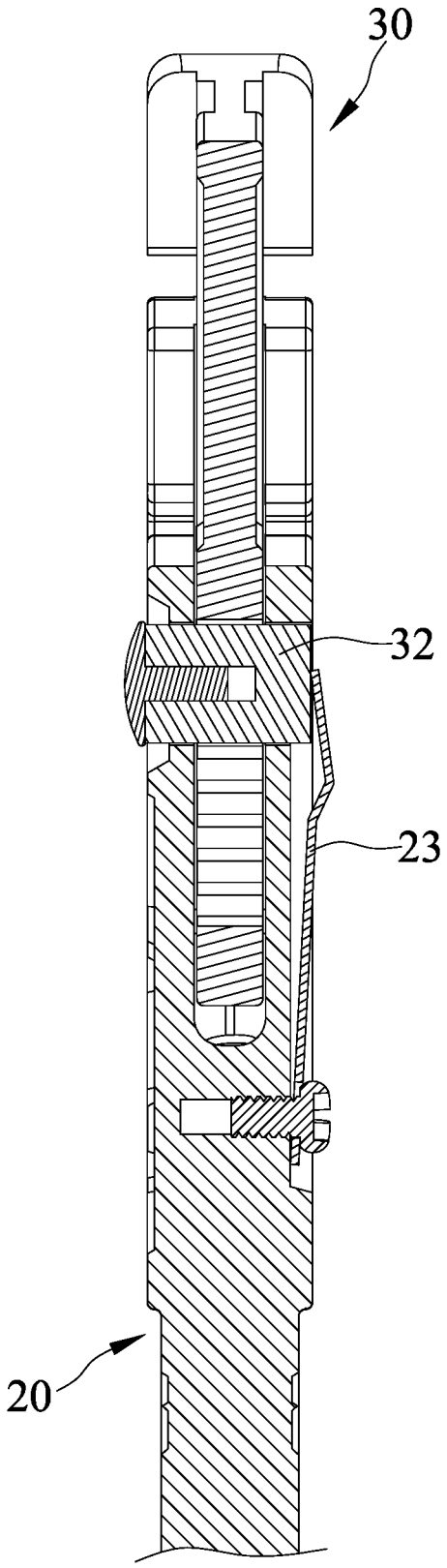
FIG. 5 is another partial, cross sectional view of the adjustable open end wrench of FIG. 1.

With reference to FIGS. 1-5, an adjustable open end wrench 10 of an embodiment according to the present invention includes a handle 20, a first jaw 30, and a second jaw 40. The handle 20 includes an end having a first pivotal portion 21 and a second pivotal portion 22. The first pivotal portion 21 includes a pivotal hole 211.

The first jaw 30 includes a pivotal groove 31. A pivot 32 is disposed to the first jaw 30 and extends through the pivotal hole 211 and the pivotal groove 31, permitting the first jaw 30 to pivot relative to the handle 20. The first jaw 30 includes a first driving portion 33.

The second jaw 40 is pivotably connected to the second pivotal portion 22. The second jaw 40 is slidably connected to the first jaw 30. An end of the second jaw 40 opposite to the first jaw 30 is connected to an elastic element 41. An end of the elastic element 41 is connected to the second jaw 40. Another end of the elastic element 41 is connected to the handle 20. The second jaw 40 includes a second driving portion 42. The first and second driving portions 33 and 42 face each other. The first and second jaws 30 and 40 are jointly pivotable relative to the handle 20 between a first position and a second position. The first and second driving portions 33 and 42 are close to each other when the first and second jaws 30 and 40 are in the first position. The first and second driving portions 33 and 42 are away from each other when the first and second jaws 30 and 40 are in the second position. The elastic element 41 is configured to move the second jaw 40 towards the first position. In an example, the elastic element 41 is a tension spring.

The second pivotal portion 22 includes a first peripheral portion having a first pivotal groove 221. A first pivotal ear 43 protrudes from the second jaw 40 and is received in the first pivotal groove 221. The second jaw 40 is pivotable relative to the handle 20 about a pivotal axis defined by the first pivotal ear 43.

The second pivotal portion 22 includes a second peripheral portion having a first limiting groove 222. The second peripheral portion is located between the first peripheral portion and another end of the handle 20. A first limiting block 44 protrudes from the second jaw 40 and is located on a side of the first pivotal ear 43 opposite to the second driving portion 42. The first limiting block 44 abuts against an inner wall of the first limiting groove 222 when the second jaw 40 is in the first position. The first limiting block 44 disengages from the first limiting groove 222 when the second jaw 40 is in the second position.

The pivotal groove 31 includes a first coupling portion 311 on an inner wall thereof. The pivot 32 includes a second coupling portion 321 on an outer periphery thereof. The pivot 32 is movable along a longitudinal axis thereof to couple the second coupling portion 321 with the first coupling portion 311 or to disengage the second coupling portion 321 from the first coupling portion 311. The pivot 32 is prevented from moving in the pivotal groove 31 in a radial direction perpendicular to the longitudinal axis when the second coupling portion 321 engages with the first coupling portion 311. The pivot 32 is movable in the pivotal groove 31 in the radial direction perpendicular to the longitudinal axis when the second coupling portion 321 disengages from the first coupling portion 311.

A stop plate 23 includes a first end mounted to the handle 20 and a second end abutting an end of the pivot 32. The stop plate 23 is resilient and is configured to bias the pivot 32 to couple the second coupling portion 321 with the first coupling portion 311.

The handle 20 includes a first lug 24 and a second lug 25. The pivotal hole 21 extends through the first lug 24 and the second lug 25. The first jaw 30 is disposed between the first lug 24 and the second lug 25. The first pivotal groove 221 and the first limiting groove 222 are located on an outer periphery of the first lug 24. The second lug 25 includes an outer periphery having a second pivotal groove 251 and a second limiting groove 252. The second jaw 40 includes a second pivotal ear 45 and a second limiting block 46. The second pivotal ear 45 is received in the second pivotal groove 251 to permit the second jaw 40 to pivot relative to the handle 20 about the pivotal axis defined by the first and second pivotal ears 43 and 45. The second limiting block 46 is located on a side of the second pivotal ear 45 opposite to the second driving portion 42. The second limiting block 46 abuts against an inner wall of the second limiting groove 252 when the second jaw 40 is in the first position. The second limiting block 46 disengages from the second limiting groove 252 when the second jaw 40 is in the second position.

The first jaw 30 includes a first sliding groove 34 and a second sliding groove 35 which are disposed on two opposite sides of the first jaw 30. The second jaw 40 includes a receiving groove 47. The first jaw 30 is slidably received in the receiving groove 47. The first pivotal ear 43 and the second pivotal ear 45 are located on two sides of the receiving groove 47, respectively. The first limiting block 44 and the second limiting block 46 are located on two sides of the receiving groove 47, respectively. The receiving groove 47 includes a first sliding ledge 471 and a second sliding ledge 472 on two opposite walls thereof. The first sliding ledge 471 is received in the first sliding groove 34. The second sliding ledge 472 is received in the second sliding groove 35. The first and second sliding ledges 471 and 472 are located between the first lug 24 and the second lug 25.

Figure 6:
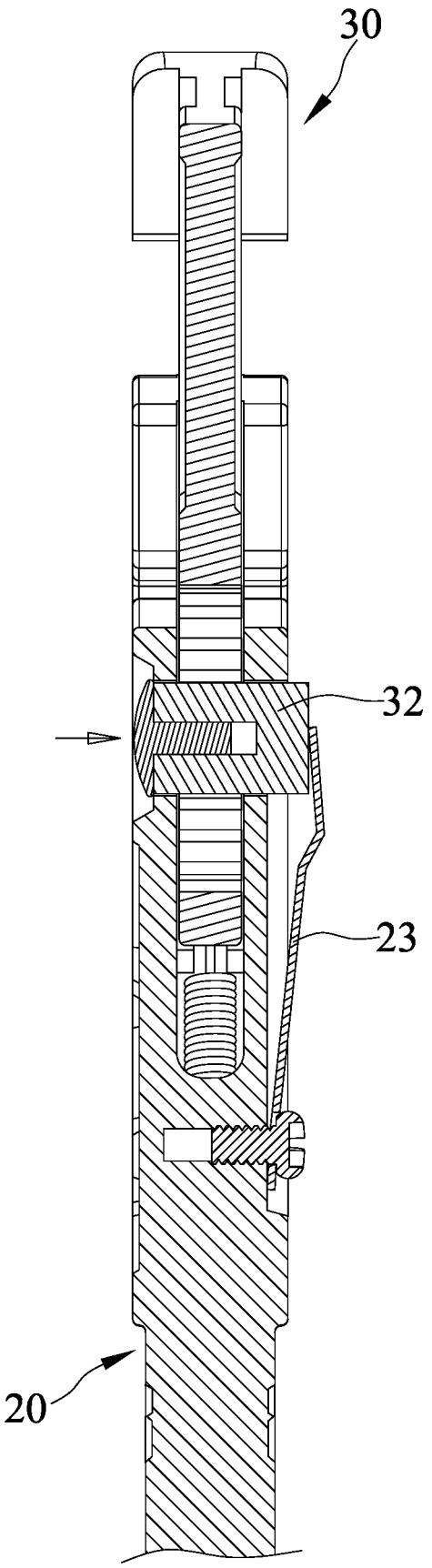
FIG. 6 is a cross sectional view similar to FIG. 5, illustrating adjustment of a width of an opening of the adjustable open end wrench.
Figure 7:
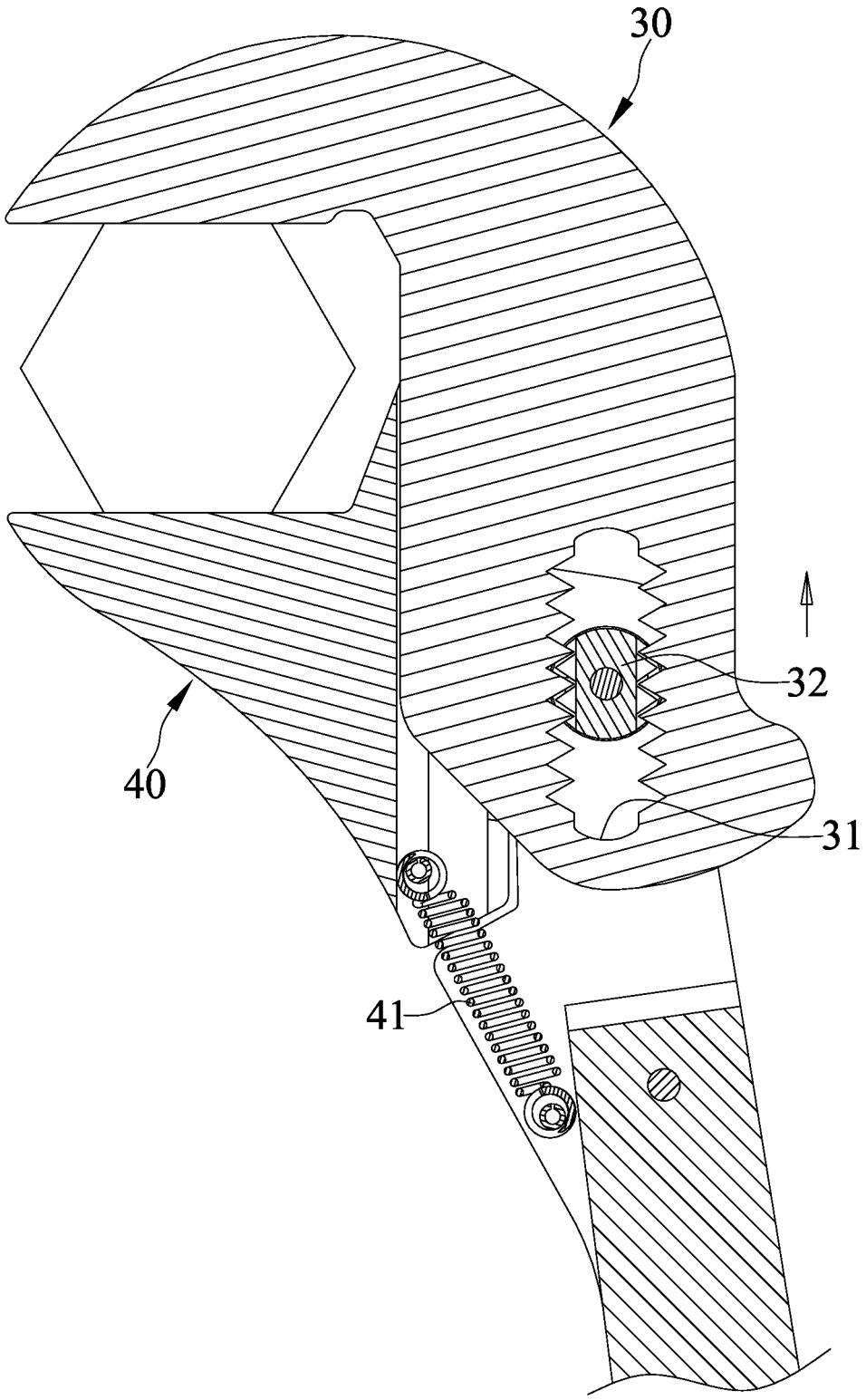
FIG. 7 is a cross sectional view similar to FIG. 4, illustrating adjustment of the width of the opening of the adjustable open end wrench.
Figure 8:
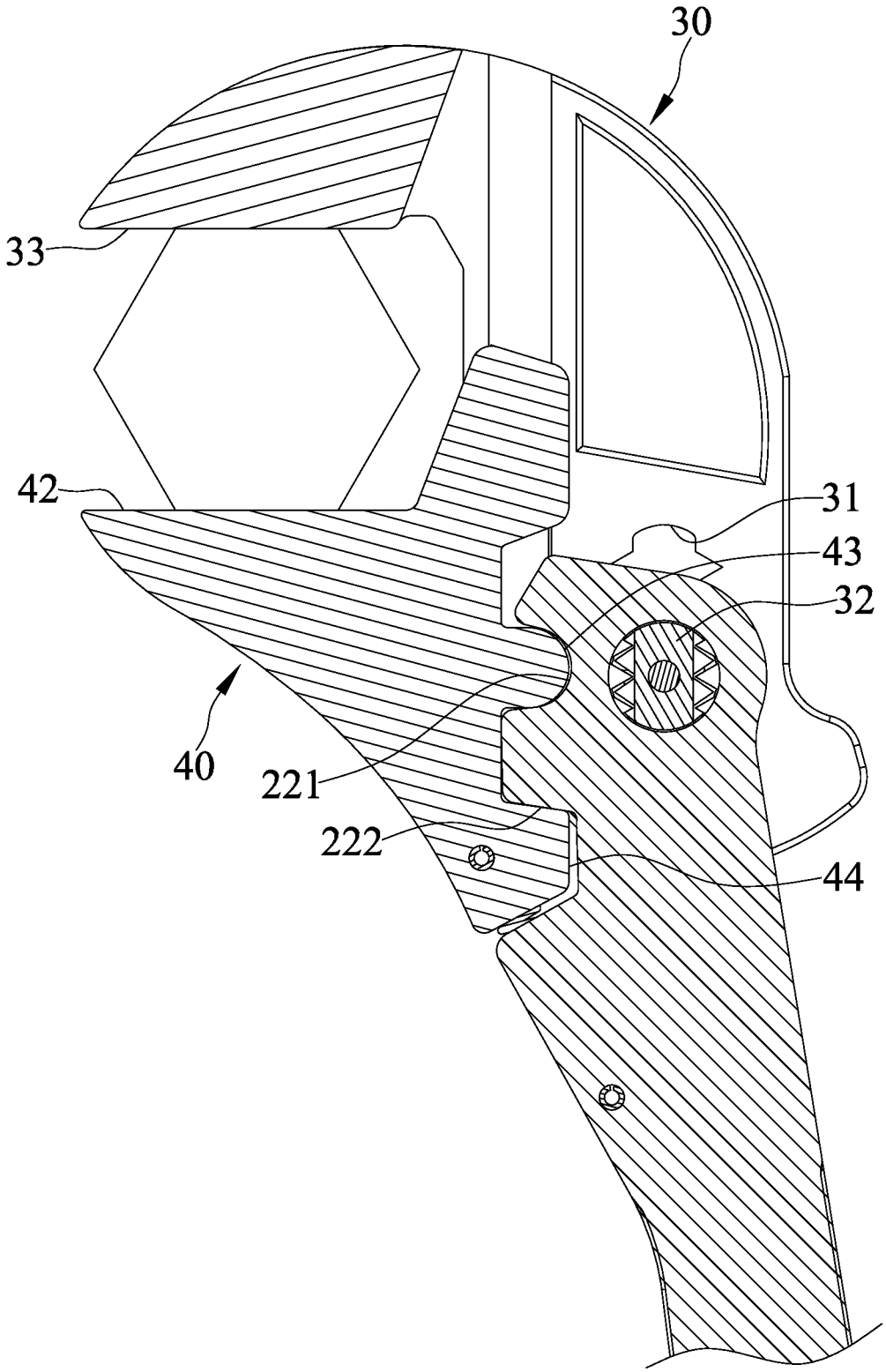
FIG. 8 is a partial, cross sectional view illustrating wrench operation of a bolt by the adjustable open end wrench of FIG. 1.
Figure 9:
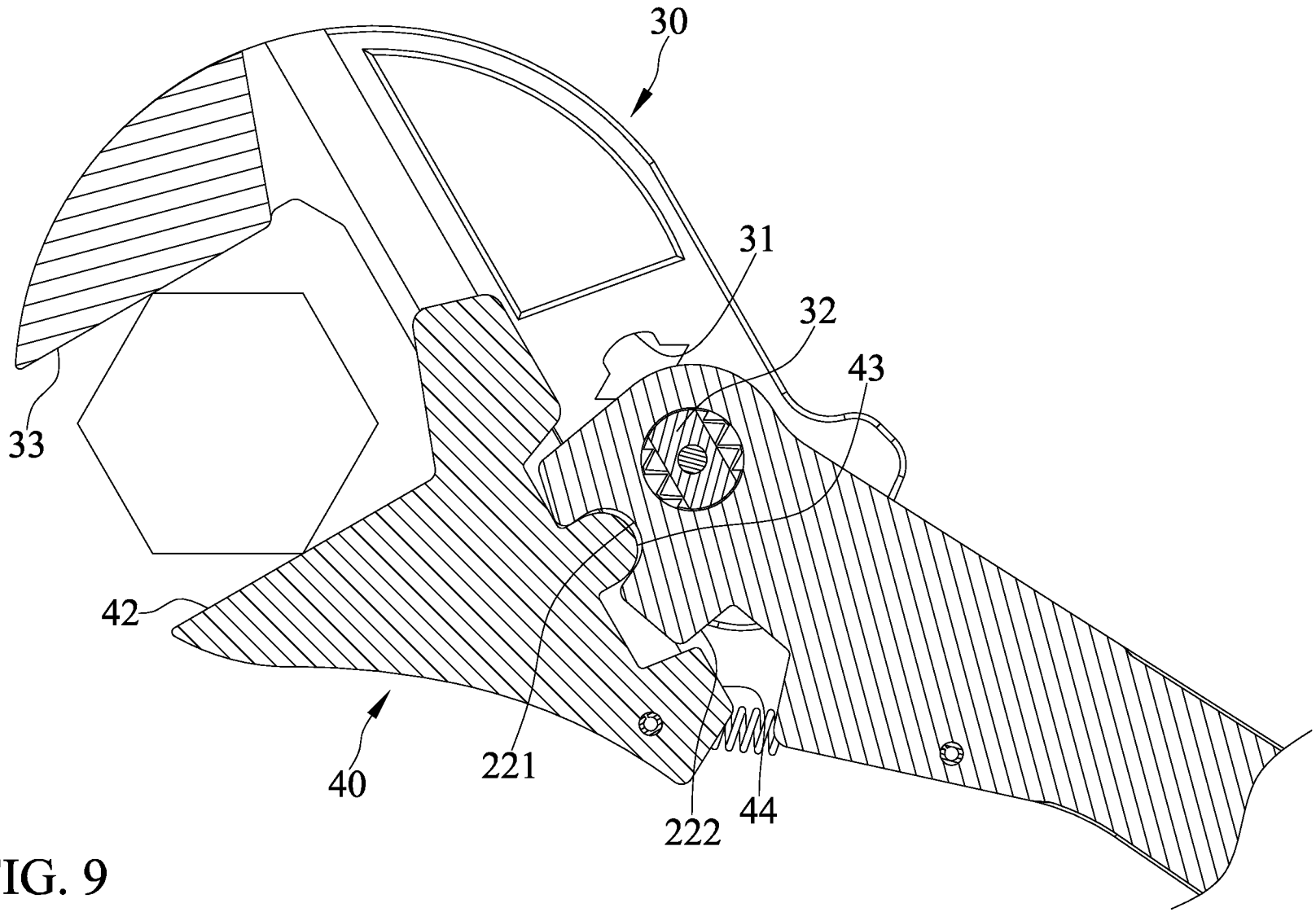
FIG. 9 is a cross sectional view similar to FIG. 8 with the adjustable open end wrench rotated clockwise and with an elastic element stretched.
Figure 10:
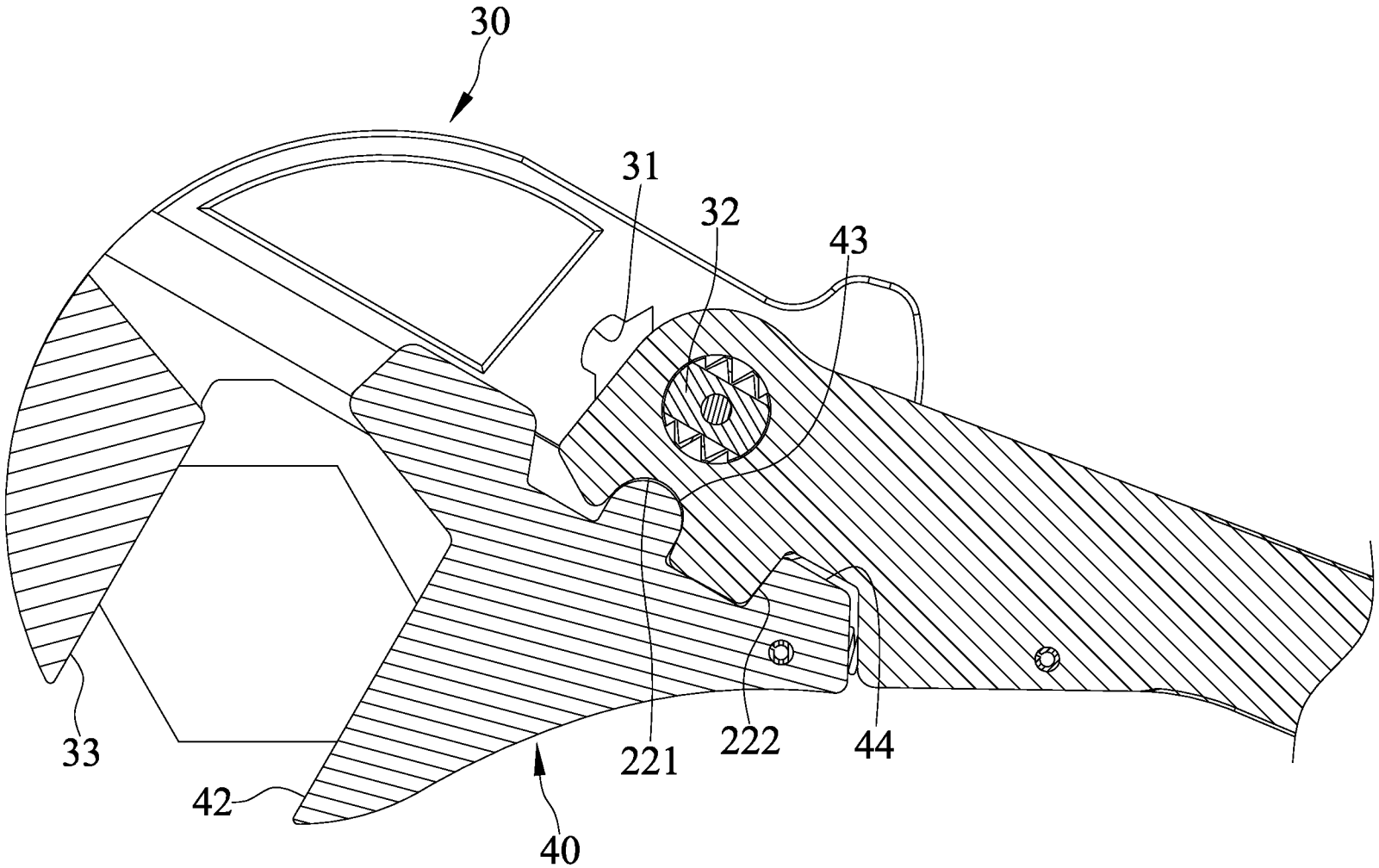
FIG. 10 is a cross sectional view similar to FIG. 9 with the elastic element returned.

FIGS. 6-10 show adjustment and operation of the adjustable open end wrench 10 according to the present invention. With reference to FIG. 6, when the pivot 32 is pushed to a position in which the second coupling portion 321 disengages from the first coupling portion 311, the first jaw 30 is movable relative to the second jaw 40 to adjust a width of an opening defined between the first jaw 30 and the second jaw 40. When the desired width is obtained, the pivot 32 is released, and the stop plate 23 returns the pivot 32 to a position in which the second coupling portion 321 engages with the first coupling portion 311.

Although specific embodiments have been illustrated and described, numerous modifications and variations are still possible without departing from the scope of the invention. The scope of the invention is limited by the accompanying claims.

The invention claimed is:

1. An adjustable open end wrench comprising:

a handle including an end having a first pivotal portion and a second pivotal portion, wherein the first pivotal portion includes a pivotal hole;

a first jaw including a pivotal groove, wherein a pivot is disposed to the first jaw and extends through the pivotal hole and the pivotal groove, permitting the first jaw to pivot relative to the handle, and wherein the first jaw includes a first driving portion; and a second jaw pivotably connected to the second pivotal portion, wherein the second jaw is slidably connected to the first jaw, wherein an end of the second jaw opposite to the first jaw is connected to an elastic element, wherein an end of the elastic element is connected to the second jaw, wherein another end of the elastic element is connected to the handle, wherein the second jaw includes a second driving portion, wherein the first and second driving portions face each other, wherein the first and second jaws are jointly pivotable relative to the handle between a first position and a second position, wherein the first and second driving portions are close to each other when the first and second jaws are in the first position, wherein the first and second driving portions are away from each other when the first and second jaws are in the second position, and wherein the elastic element is configured to move the second jaw towards the first position wherein the second pivotal portion includes a first peripheral portion having a first pivotal groove, wherein a first pivotal ear protrudes from the second jaw and is received in the first pivotal groove, and wherein the second jaw is pivotable relative to the handle about a pivotal axis defined by the first pivotal ear wherein the second pivotal portion includes a second peripheral portion having a first limiting groove, wherein the second peripheral portion is located between the first peripheral portion and another end of the handle, wherein a first limiting block protrudes from the second jaw and is located on a side of the first pivotal ear opposite to the second driving portion, wherein the first limiting block abuts against an inner wall of the first limiting groove when the second jaw is in the first position, and wherein the first limiting block disengages from the first limiting groove when the second jaw is in the second position.

2. The adjustable open end wrench as claimed in claim 1, wherein the pivotal groove includes a first coupling portion on an inner wall thereof, wherein the pivot includes a second coupling portion on an outer periphery thereof, wherein the pivot is movable along a longitudinal axis thereof to couple the second coupling portion with the first coupling portion or to disengage the second coupling portion from the first coupling portion, wherein the pivot is prevented from moving in the pivotal groove in a radial direction perpendicular to the longitudinal axis when the second coupling portion engages with the first coupling portion, and wherein the pivot is movable in the pivotal groove in the radial direction perpendicular to the longitudinal axis when the second coupling portion disengages from the first coupling portion.

3. The adjustable open end wrench as claimed in claim 2, wherein a stop plate includes a first end mounted to the handle and a second end abutting an end of the pivot, and wherein the stop plate is resilient and is configured to bias the pivot to couple the second coupling portion with the first coupling portion.

4. The adjustable open end wrench as claimed in claim 3, wherein the handle includes a first lug and a second lug, wherein the pivotal hole extends through the first lug and the second lug, wherein the first jaw is disposed between the first lug and the second lug, wherein the first pivotal groove and the first limiting groove are located on an outer periphery of the first lug, wherein the second lug includes an outer periphery having a second pivotal groove and a second limiting groove, wherein the second jaw includes a second pivotal ear and a second limiting block, wherein the second pivotal ear is received in the second pivotal groove to permit the second jaw to pivot relative to the handle about the pivot axis defined by the first and second pivotal ears, wherein the second limiting block is located on a side of the second pivotal ear opposite to the second driving portion, wherein the second limiting block abuts against an inner wall of the second limiting groove when the second jaw is in the first position, and wherein the second limiting block disengages from the second limiting groove when the second jaw is in the second position.

5. The adjustable open end wrench as claimed in claim 4, wherein the first jaw includes a first sliding groove and a second sliding groove which are disposed on two opposite sides of the first jaw, wherein the second jaw includes a receiving groove, wherein the first jaw is slidably received in the receiving groove, wherein the first pivotal ear and the second pivotal ear are located on two sides of the receiving groove, respectively, wherein the first limiting block and the second limiting block are located on two sides of the receiving groove, respectively, wherein the receiving groove includes a first sliding ledge and a second sliding ledge on two opposite walls thereof, wherein the first sliding ledge is received in the first sliding groove, and wherein the second sliding ledge is received in the second sliding groove.

6. The adjustable open end wrench as claimed in claim 5, wherein the first and second sliding ledges and are located between the first lug and the second lug.

7. The adjustable open end wrench as claimed in claim 6, wherein the elastic element is a tension spring.

* * * * *